US005254016A

United States Patent [19]

Ganthier

[11] Patent Number: 5,254,016

[45] Date of Patent: Oct. 19, 1993

[54] INTERCONNECT DEVICE MOUNTING APPARATUS FOR PRINTED CIRCUIT BOARDS

[75] Inventor: James J. Ganthier, Spring, Tex.

[73] Assignee: Compaq Computer Corporation, Houston, Tex.

[21] Appl. No.: 899,735

[22] Filed: Jun. 17, 1992

[51] Int. Cl.[5] ..... H01R 13/73

[52] U.S. Cl. ..... 439/567; 439/571; 439/78; 411/339

[58] Field of Search ..... 439/78, 567, 571, 557, 439/554, 573; 411/339

[56] References Cited

U.S. PATENT DOCUMENTS

| | | | |
|---|---|---|---|
| 1,374,713 | 4/1921 | Bell | 411/339 |
| 4,173,387 | 11/1979 | Zell | 439/557 |
| 4,363,530 | 12/1982 | Verhoeves | 439/571 |
| 5,076,794 | 12/1991 | Ganthier | 439/70 |
| 5,080,611 | 1/1992 | Hypes | 439/554 |
| 5,083,942 | 1/1992 | Hahn | 439/567 |

FOREIGN PATENT DOCUMENTS

| | | | |
|---|---|---|---|
| 105395 | 10/1938 | Australia | 411/339 |

*Primary Examiner*—Gary F. Paumen
*Attorney, Agent, or Firm*—Konneker, Bush & Hitt

[57] ABSTRACT

A pair of surface mountable electrical component interconnect devices are mounted in a back-to-back relationship on opposite side surfaces of a printed circuit board using specially designed elongated fastening structures that longitudinally extend through mounting holes in the circuit board and corresponding openings in the support board portions of the interconnect devices. Each of the fastening structures is of a plastic material and comprises male and female telescopingly engageable longitudinal sections, provided with enlarged head portions, that may be simply snapped together in an axial direction to create a firm locking engagement between annular exterior and interior barb portions respectively formed on the male and female sections. The female sections are also provided with annular exterior barbs which may be snapped through the circuit board mounting holes to hold one of the interconnect devices on the board while the other interconnect device is being attached by snapping the male fastener portions into their associated, in-place female portions. The enlarged heads on the fastener structure sections function to press spaced apart conductor portions of the interconnect devices against electrically conductive contact areas surface mounted on the opposite sides of the printed circuit board.

10 Claims, 3 Drawing Sheets

INTERCONNECT DEVICE MOUNTING APPARATUS FOR PRINTED CIRCUIT BOARDS

BACKGROUND OF THE INVENTION

Field of the Invention

The present invention relates generally to printed circuit board apparatus, and more particularly relates to apparatus for mounting electrical component interconnect devices on printed circuit boards.

Description of Related Art

Electrical components, such as processors, are typically mounted on printed circuit boards using interconnect devices interposed between the components and the circuit board and connected to a side of the circuit board to electrically couple the component thereto. In a conventional form thereof , a typical interconnect device comprises a support board or "housing" portion in which are mounted a spaced series of electrically conductive pin members having first end portions that transversely project outwardly beyond one side of the support board, and socketed second end portions that receive corresponding pins, on the component to be mounted, from the other side of the support board. To electrically couple the component to the printed circuit board, the first end portions of the interconnect device pins are inserted into conductively plated through-holes extending transversely through the printed circuit board.

The use of this conventional through-hole mounting technique typically precludes the placement of electrical circuitry, or another electrical component, on the opposite circuit board side within the footprint of the mounted component. In an effort to more efficiently use circuit board side space, various methods have been proposed for mounting an interconnect device on a side of a printed circuit board without the use of plated through-holes. These surface mounting techniques typically comprise forming, in place of the through-holes, electrically conductive contact pads on a side surface of the circuit board and holding electrically conductive coupling portions of the interconnect device against these surface mounted contact pads.

One method of accomplishing this holding function is to place a hold-down plate on the top side of the electrical component secured to the interconnect device hen secure the hold-down plate to the circuit board using ordinary fastening members, such as screws or bolts, extending through mounting holes in the circuit board. While this surface mounting technique frees up circuit board space on the opposite board side surface area directly beneath the mounted interconnect device, and the electrical component secured thereto, due to the presence of the fastener mounting holes and fastener portions projecting therethrough this freed up circuit board side surface space has heretofore been usable only for relatively small circuitry portions such as surface traces, chips and chip caps, but not for another interconnect device.

For purposes of even further printed circuit board space savings, it would be desirable to provide apparatus for surface mounting two interconnect devices in a back-to-back relationship on opposite sides of the same portion of a printed circuit board. It is accordingly an object of the present invention to provide such mounting apparatus.

SUMMARY OF THE INVENTION

In carrying out principles of the present invention, in accordance with a preferred embodiment thereof , two interconnect devices are compactly surface mounted in a back-to-back relationship on opposite sides of the same portion of a printed circuit board using a plurality of specially designed fastening structures.

Each fastening structure representatively comprises molded plastic cylindrical male and female longitudinal sections that may be telescopingly engaged with one another. When so engaged, the two sections are firmly interlocked with one another by means of exterior annular barbs, formed on the male section, that overlap with corresponding annular barbs formed on the interior surface of the female section. As the connection is being made, the resilient barbs deflect until a final snap-action interfit therebetween is formed.

In operatively connecting the two interconnect devices to the opposite sides of the circuit board, the female fastener sections are passed inwardly through openings formed in the support board portion of the first interconnect devices, and then through corresponding mounting holes formed in the circuit board. Enlarged head portions on the outer ends of the female sections abut the support board and exert an inwardly directed hold-down force thereon when the male sections are operatively snapped into the in-place female sections. According to a feature of the present invention, the female sections are provided with exterior annular barbs that resiliently snap into the circuit board mounting holes to thereby hold the first interconnect device in place while the second interconnect device is being operatively attached to the other side of the circuit board generally within the footprint of the first interconnect device.

The second interconnect device is then mounted by passing the male fastener sections inwardly sections inwardly through openings in the second interconnect device support and into the in-place female fastener sections to effect the previously mentioned snap-fit interlock therewith. With such snap-fit interlock achieved, enlarged outer head portions on the male sections exert an appropriate hold-down force on the second interconnect device.

While the two-piece fastening structures provide a rapid and relatively inexpensive method of mounting the two interconnect devices in a compact, back orientation on the circuit board, other types of elongated fastening structures could also be used for this space-saving purpose. Additionally, the fastening structures could be used to exert inwardly directed hold-down forces on the two interconnect devices in other manners, if desired. For example, instead of extending the fastener sections through openings in the interconnect device support boards, hold-down plates could be positioned along the oppositely facing outer sides of the electrical components secured to the interconnect devices, and the fastener sections extended inwardly through openings formed in these hold-down plates. The fastener structures may be used to mount a variety of interconnect device types in the described back-to-back orientation, three representative types of interconnect devices being illustrated and described herein.

DETAILED DESCRIPTION

Figure 1:
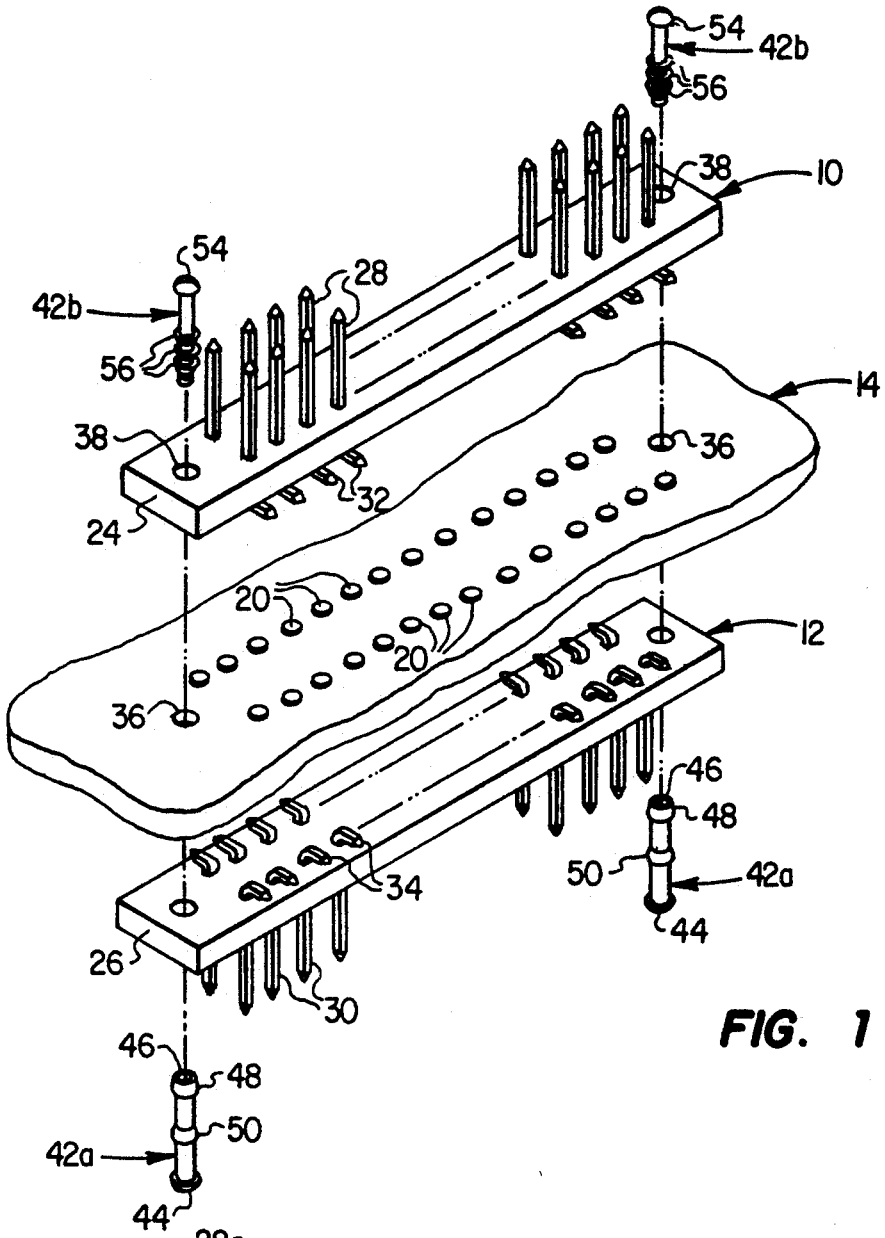
FIG. 1 is an exploded perspective view of a compact, surface mountable interconnect structure that embodies principles of the present invention and is used to operatively couple a pair of electrical components of opposite sides of the same portion of a representative printed circuit board.
Figure 2:
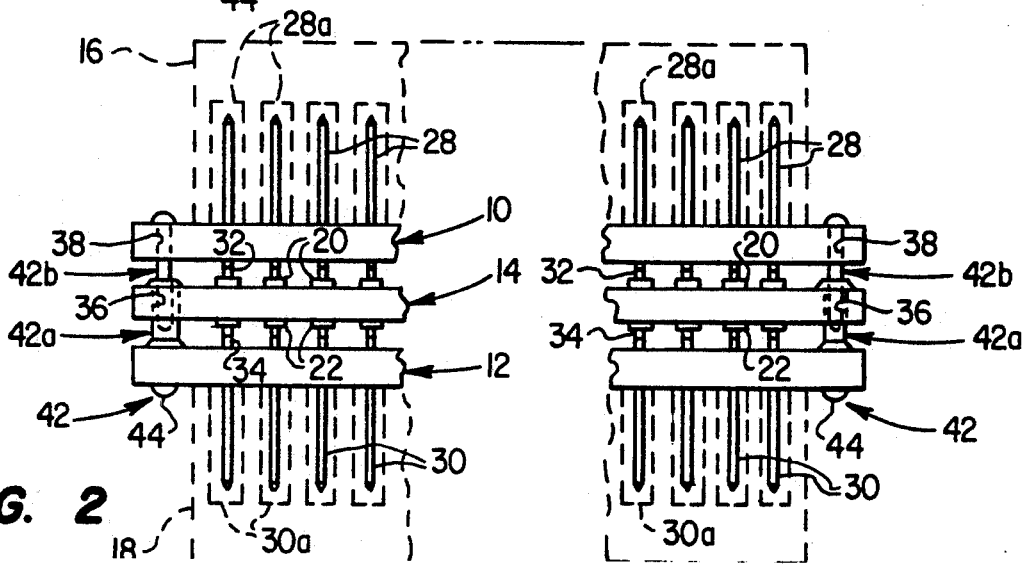
FIG. 2 is a horizontally foreshortened cross-sectional view through the interconnect structure in an assembled state and additionally illustrating, in phantom, a pair of representative electrical components operatively secured to the assembled interconnect structure.
Figure 3:
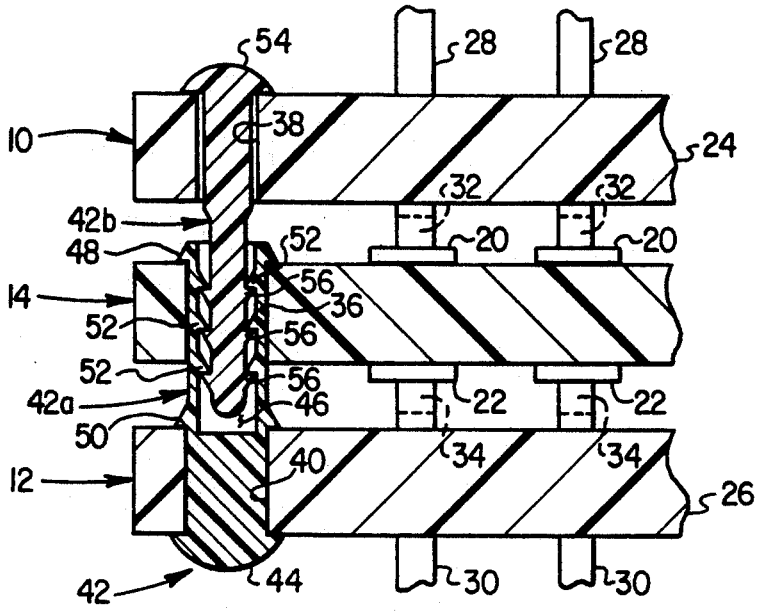
FIG. 3 is a cross-sectional enlargement of a left end portion of the structure shown in FIG. 2 illustrating one of the pair of interlockable securement members used to cooperatively support portions of the overall interconnect structure on opposite sides of the printed circuit board.

Illustrated in FIGS. 1–3 is a space-saving securement structure used to operatively mount a pair of interconnect devices, representatively in the form of the depicted interconnect headers 10 and 12, in a back-to-back relationship on opposite sides of the same portion of a printed circuit board 14. In a manner subsequently described, the interconnect devices 10,12 are used to respectively couple a pair of electrical components, such as the illustrated memory modules 16 and 18, to spaced series of electrically conductive contact pads surface mounted on the top and bottom sides of the circuit board 14 and suitably connected to electrically conductive surface traces (not shown) forming a portion of the overall board circuitry.

The top and bottom interconnect headers 10 and 12 have elongated rectangular support board portions 24 and 26 in which spaced series of connector pins 28 and 30 are anchored and transversely project outwardly from the outer sides of the support boards 24 and 26, respectively. As best illustrated in FIG. 2, the pins 28,30 are insertable in complimentarily configured sockets 28,30*a* respectively formed in the memory modules 16,18. The outwardly projecting inner ends of the pins 28,30 are transversely bent to form solder lead portions 32,34 that are respectively alignable and engageable with the surface mounted contact pads 20,22 to electrically couple the pads to their associated interconnect headers.

The securement structure of the present invention includes a pair of mounting holes 36 formed through the circuit board 14 outwardly of the opposite ends of the arrays of contact pads 20 and 22; openings 38 extending through the opposite ends of the support board 14 and alignable with the mounting holes 36; openings 40 extending through the opposite ends of the support board 26 and alignable with the mounting holes 36; and a pair of specially designed, two-piece molded plastic fastener structures 42. Each fastener structure 42 includes elongated, generally cylindrical female and male sections 42*a* and 42*b* that, in a manner subsequently described, may be longitudinally snapped together into a firmly interlocked relationship to hold the interconnect headers 10 and 12 in their spacesaving back-to-back relationship on opposite sides of the circuit board 14 as shown in FIGS. 2 and 3.

Each of the female fastener sections 42*a* has an enlarged head portion 44 its outer end; a cylindrical socket 46 extending axially inwardly through its inner end; an annular exterior barb 48 extending around its inner end; an annular exterior barb 50 intermediate the barb 48 and the enlarged head 44; and an axially spaced series of annular barbs 52 (see FIG. 3) formed on the interior side surface of socket 46. Each of the male fastener sections 42*b* has an enlarged head portion 54 on its outer end, and an axially spaced series of annular exterior barbs 56 formed on an inner end portion thereof. The axial spacing of the barbs 56 is identical to that of the interior barbs 52 within the female fastener sections 42*a*.

To operatively mount the interconnect headers 10,12 on the opposite sides of the circuit board 14 as shown in FIGS. 2 and 3, the female fastener sections 42*a* are first pushed upwardly through the openings 40 in the lower support board 26. As the fastener sections 42*a* progressively pass through the openings 40, the exterior barbs 48, 50 are resiliently deflected, thereby permitting their passage through such openings, and then laterally spring back to their original shapes. Accordingly, after the barbs 50 have been forced through the openings 40 they snap outwardly to firmly lock the fastener sections 42*a* on the support board 26, with the enlarged fastener section head portions 44 in abutment with the underside of the support board 26.

Next, the inner or upper ends of the fastener sections 42*a* are forced upwardly through the circuit board mounting holes 36 until the annular barbs 48 snap outwardly into place along the top side of the support board 26. When this occurs, the lower interconnect header 12 is locked into place on the underside of the circuit board 14, with the solder leads 34 aligned with the contact pads 22 and forcibly held in contact therewith by virtue of the upwardly directed holding force exerted on the support board 26 by the enlarged fastener section head portions 44. This conveniently holds the lower interconnect header 12 in place while the upper interconnect header 10 is fastened to the top side of the circuit board 14.

To operatively mount the top interconnect header 10 in a space-saving back-to-back relationship with the already mounted bottom interconnect board 12, the male fastener sections 42*b* are simply passed downwardly through the upper support board openings 38, and the inner or lower end portions of the fastener sections 42*b* forced into the sockets 42 of the female fastener sections 42*a*. As the inner end portions of the fastener sections 42*b* pass downwardly into their associated sockets 42, their annular barbs 52 are inwardly deflected and snap back into place in underlying, horizontally overlapping relationships with their associated female fastener section barb portions 52, as best illustrated in FIG. 3, thereby locking the fastener sections 42*a*,42*b* together and pressing the solder leads 32 against the contact pads 20 by virtue of the downward force exerted on the top support board 24 by the enlarged fastener section head portions 54.

The use of the fastener structures 42 just described provides for the rapid and relatively inexpensive connection of two interconnect devices, in a back-to-back orientation, on opposite sides of a printed circuit board as shown. However, fastener structures of other configurations could alternatively be used if desired. Moreover, the hold-down forces achieved by the direct association of the fastener head portions 44;54 with the support boards 26,24 could be achieved in other manners. For example, if desired, the opposite ends of the support boards 24,26 could be shortened, and their mounting holes 38,40 eliminated. The illustrated fastener structures 42 could correspondingly be lengthened and passed through openings in hold-down plates (not illustrated) positioned against the outer sides of the memory modules 16,18. The outer ends of the assembled fastener structures would then exert their hold-down forces on the interconnect devices via the memory modules.

Figure 4:
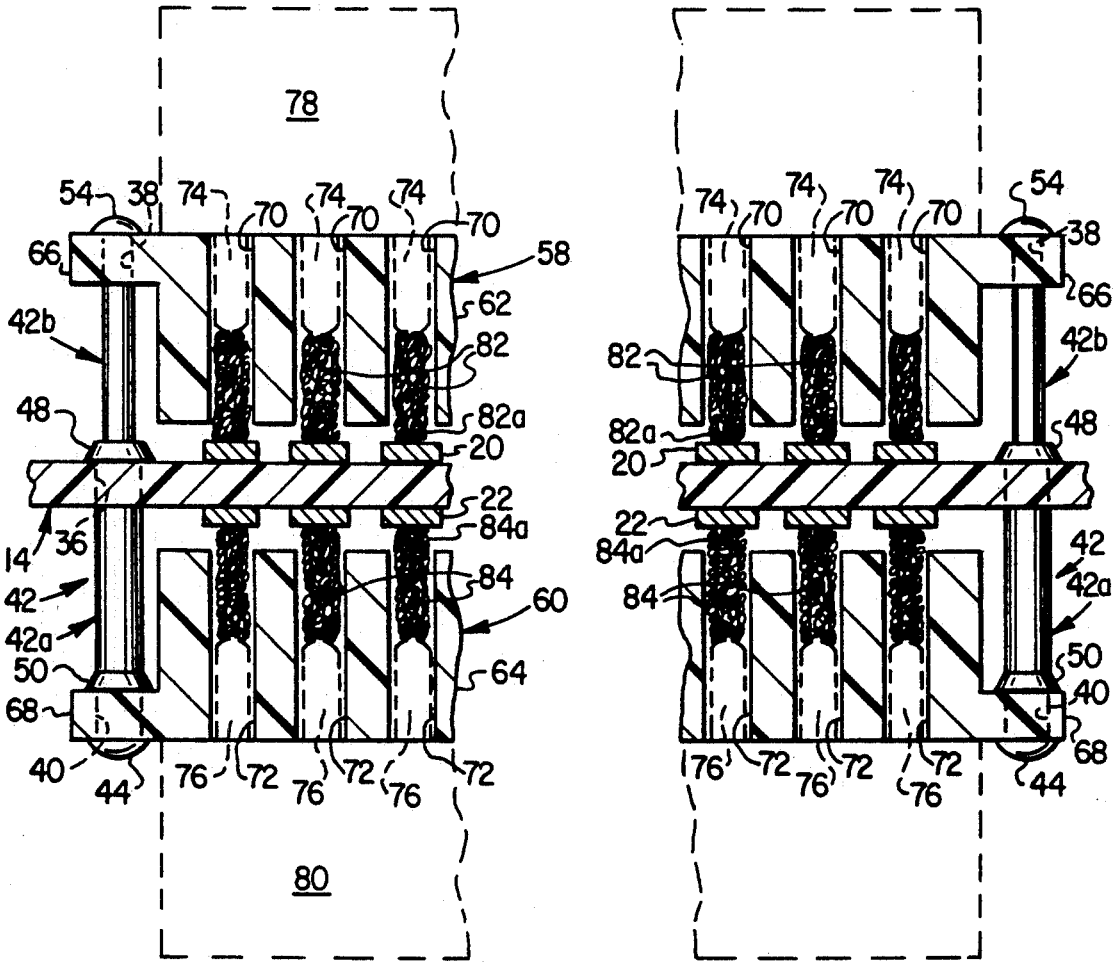
FIG. 4 is a horizontally foreshortened cross-sectional view through a first representative alternate embodiment of the surface mountable interconnect structure.

The securement structure described above can also be advantageously utilized with interconnect devices other than the representative interconnect headers 10,12. For example, as illustrated in FIG. 4, it may be used in conjunction with the top and bottom interconnect devices 58,60 which are similar in construction and operation to the specially designed interconnect device illustrated and described in copending U.S. application Ser. No. 07/900,595 assigned to the assignee of the present application.

The interconnect devices 58,60 have support board portions 62,64 with outwardly projecting tabs 66,68 through which the previously described mounting openings 38,40 are respectively extended. Spaced series of transverse through-holes 70,72 are respectively formed in the support boards 58,60 and inwardly receive the connector pin portions 74,76 of a pair of electrical components such as the illustrated processors 78,80. Packed tightly in the through-holes 70 and 72, inwardly of the received connector pins, are randomly coiled electrically conductive wire arrays 82,84. These wire arrays have outwardly projecting end portions 82*a*,84*a* which are respectively aligned and in contact with the surface mounted contact pads 20,22. As illustrated, the fastener structures 42 extend through the support board openings 38 and 40, and the circuit board mounting holes 36, and exert hold-down forces on the support boards 62,64 that resiliently depress the wire array end portions 82*a*,84*a* respectively against the contact pads 20,22. Like the previously described interconnect device pins 28 and 30, the wire arrays 82,84 function as coupling means for electrically coupling the surface mounted contact pads 20 and 22, via the processor pins 74 and 76, to the processors 78 and 80.

Figure 5:
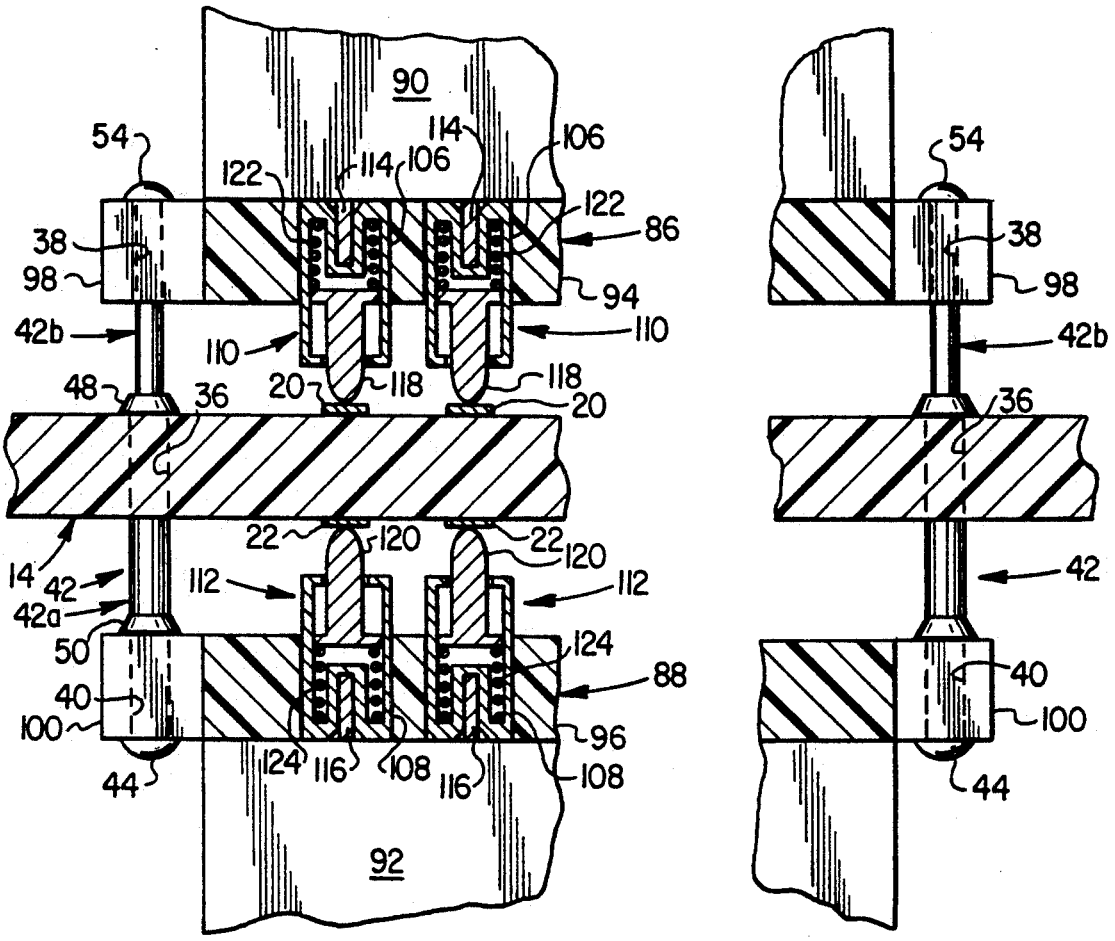
FIG. 5 is a horizontally foreshortened cross-sectional view through a second representative alternate embodiment of the surface mountable interconnect structure.

In FIG. 5, a pair of the fastener structures 42 are representatively shown mounting a pair of interconnect devices 86,88 in a back-to-back relationship on the top and bottom sides of the circuit board 14, with the interconnect devices being respectively secured to a pair of processors 90,92 and electrically coupling them to the surface mounted contact pads 20,22.

The interconnect devices 86,88 are similar in construction and operation to the interconnect device shown in FIG. 3 of my U.S. Pat. No. 5,076,794 and have support board portions 94,96 with tabs 98,100 through which the previously described mounting openings 38,40 respectively extend. Also as previously described, the assembled fastener structures 42 longitudinally extend through the support board openings 38,40 and the circuit board mounting holes 36.

The support boards 94,96 have spaced series of transverse through-holes 102,104 respectively disposed thereon. Anchored in these through-holes are the barrel portions 106,108 of electrically conductive pin structures 110,112 which are respectively aligned with the series of contact pads 20,22. As illustrated, the barrel portions 106,108 are socketed and inwardly receive corresponding connector pin portions 114,116 of the processors 90,92. Outer end portions 118,120 of the pin structures 110,112 are respectively telescoped in the barrel portions 106,108 and are resiliently biased outwardly toward the circuit board sides by springs 122,124 respectively positioned within the barrel portions 106,108. The inwardly directed hold-down forces exerted on the support boards 94,96 by the fastener structures 42 operate to resiliently depress the inner pin end portions 118,120 respectively against the surface mounted contact pads 20,22 as illustrated in FIG. 5.

The foregoing detailed description is to be clearly understood as being given by way of illustration and example only, the spirit and scope of the present invention being limited solely by the appended claims.

What is claimed is:

1. Apparatus for operatively coupling first and second electrical components to first and second series of spaced apart electrically conductive contact areas respectively surface mounted on opposite first and second sides of the same portion of a printed circuit board, said apparatus comprising:

a first interconnect device operatively positionable in an overlying relationship with said first series of electrically conductive contact areas, said first interconnect device being securable the said first electrical component and having means, engageable with said first series of electrically conductive contact areas, for electrically coupling said first series of electrically conductive contact areas to the secured first electrical component;

a second interconnect device operatively positionable in an overlying relationship with said second series of electrically conductive contact area, said second interconnect device being securable to said second electrical component and having means, engageable with said second series of electrically conductive contact areas, for electrically coupling said second series of electrically conductive contact areas to the secured second electrical component; and holding means for respectively holding said first and second interconnect devices in their operative positions on said first and second sides of the same portion of said printed circuit board said holding means including:

a spaced plurality of mounting holes formed transversely through said printed circuit board outwardly of said first and second series of electrically conductive contact areas, a plurality of fastening structures each having first and second enlarged end portions and an intermediate portion disposed between said first and second end portions, said intermediate portions being positionable within said mounting holes with said first and second end portions respectively disposed outwardly beyond said first and second sides of said printed circuit board, and means for associating the first and second end portions of each fastening structure with each of said first and second interconnect devices in a manner such that each fastening structure exerts, on each of said first and second interconnect devices, a hold-down force directed inwardly toward said printed circuit board, each of said fastening structures including a first section having an outer end portion defining said first end portion of the fastening structure, a second section having an outer end portion defining said second end portion of the fastening structure, and an inner end portion telescopingly engageable with said inner end portion of said first section, and cooperating means on said inner end portions for securely holding them in their telescopingly engaged relationship, one of said first and second sections being insertable through one of said mounting holes and being provided with snap-action means for locking it to said printed circuit board in response to such insertion.

2. The apparatus of claim 1 wherein, for each of said fastening structures:

the inner end portion of one of said first and second sections is hollow, is adapted to telescopingly receive the inner end portion of the other of said first and second sections, and has an inner side surface, the inner end portion of the other of said first and second sections has an outer side surface, and said cooperating means include enlarged deflectable portions formed on said inner and outer side surfaces and configured to form a snap fit interlock between the inner end portions of said first and second sections in response to a forced telescoping engagement thereof.

3. The apparatus of claim 2 wherein:

said first and second sections have generally cylindrical configurations, and said enlarged deflectable portions have generally annular configurations.

4. The apparatus of claim 3 wherein:

said first and second sections are formed from a plastic material.

5. The apparatus of claim 1 wherein:

said one of said first and second sections has a generally cylindrical configuration, and said snap-action means include an annular, enlarged, resiliently deflectable outer side portion of said one of said first and second sections which is radially larger than the mounting hole but may be forced therethrough as said one of said first and second sections is operatively inserted therein.

6. The apparatus of claim 1 wherein said means for associating include:

a spaced plurality of first openings formed through said first interconnect device, alignable with said mounting holes, and configured to operatively receive said first end portions of said fastening structures, and a spaced plurality of second openings formed through said second interconnect device, alignable with said mounting holes, and configured to operatively receive said second end portions of said fastener structures.

7. The Printed circuit board apparatus comprising:

a printed circuit board substrate member having a portion with first and second opposite side surfaces;

a spaced plurality of first electrically conductive contact areas disposed on said first side surface of said substrate member portion;

a spaced plurality of second electrically conductive contact areas disposed on said second side surface of said substrate member portion;

a spaced plurality of mounting holes extending transversely through said substrate member outwardly of said series of first and second electrically conductive contact areas;

a first electrical component overlying said series of first electrically conductive contact areas;

a first interconnect device interposed between said first electrical component and said series of first electrically conductive contact areas, operatively secured to said first electrical component, and having first electrical coupling means engaged with said series of first electrically conductive areas and electrically coupling them to said first electrical component;

a second electrical component overlying said series of second electrically conductive contact areas;

a second interconnect device interposed between said second electrical component and said series of second electrically conductive contact areas, operatively secured to said second electrical component, and having second electrical coupling means engaged with said series of second electrically conductive contact areas and electrically coupling them to said second electrical component; and holding means for holding said first and second means in respective operative engagement with said first and second electrically conductive contact areas, said holding means including:

a plurality of fastener structures having first end portions spaced outwardly apart from said first substrate member portion side surface, second end portions spaced outwardly apart from said second side substrate member portion side surface, and intermediate portions received in said mounting holes, each of said fastener structures longitudinally extending along the axis of its associated mounting hole and comprising two telescoped longitudinal sections firmly secured to one another by laterally overlapping projections formed thereon, each pair of telescoped longitudinal sections being of a generally cylindrical configuration, and said projections being resiliently deflectable and having generally annular configurations, wherein, for each pair of telescoped longitudinal sections, a first one of said longitudinal sections axially extends into the interior of the other longitudinal section and said annular overlapping projections are disposed within the interior of said other longitudinal section, and said other longitudinal section has an enlarged annular exterior projection preventing outward withdrawal of said other longitudinal section from its associated mounting hole, and means for respectively associating said first and second end portions of each of said fastener structures with said first and second interconnect devices in a manner respectively pressing their first and second means against said first and second electrically conductive contact areas to thereby operatively mount said first and second interconnect devices in a back-to-back orientation on opposite sides of said substrate member.

8. The printed circuit board apparatus of claim 13 wherein said means for respectively associating include:

a spaced plurality of first openings formed in said first interconnect device and receiving said first end portions of said fastener structures, and a spaced plurality of second openings formed in said second interconnect device and receiving said second end portions of said fastener structures.

9. The printed circuit board apparatus of claim 13 wherein at least one of said first and second interconnect devices is an interconnect header.

10. The printed circuit board apparatus of claim 9 herein said interconnect header has a support board portion through which a spaced plurality of openings extend and receive end portions of said fastener structures.

* * * * *